United States Patent [19]

Honsel et al.

[11] 4,159,807

[45] Jul. 3, 1979

[54] APPARATUS FOR FEEDING SERIATIM DISCRETE WEBS OF PAPER OR THE LIKE

[75] Inventors: Karl-Heinz Honsel, Bielefeld; Hans-Rudolf Niehaus, Enger; Karl Mühlenweg, Bielefeld, all of Fed. Rep. of Germany

[73] Assignee: Karl-Heinz Honsel, Bielefeld, Fed. Rep. of Germany

[21] Appl. No.: 862,681

[22] Filed: Dec. 21, 1977

[30] Foreign Application Priority Data

Dec. 23, 1976 [DE] Fed. Rep. of Germany ..... 2658385

[51] Int. Cl.[2] ..... B65H 25/04

[52] U.S. Cl. ..... 242/57; 242/58; 226/11; 226/110

[58] Field of Search ..... 242/58, 57, 55.3; 226/11, 100, 108–110, 112

[56] References Cited

U.S. PATENT DOCUMENTS

| | | | |
|---|---|---|---|
| 3,128,026 | 4/1964 | Bonnell et al. | 226/110 |
| 3,325,071 | 6/1967 | Schmitz | 226/108 |
| 3,850,356 | 11/1974 | Abe et al. | 242/58 |

*Primary Examiner*—Robert J. Spar
*Assistant Examiner*—H. Grant Skaggs
*Attorney, Agent, or Firm*—Peter K. Kontler

[57] ABSTRACT

Apparatus for feeding seriatim discrete webs of paper, cardboard or synthetic plastic material to one or more processing machines has a pair of continuously driven transporting rolls, a first and a second pair of intermittently driven advancing rolls, and first and second guides which respectively compel webs to travel from the nip of the corresponding advancing rolls into the nip of the transporting rolls. Two photocells are adjacent to each guide and each photocell is shiftable in and counter to the direction of travel of a web from the respective advancing rolls toward the transporting rolls. That photocell of each pair which is nearer to the respective advancing rolls causes the generation of a visible or audible signal in response to detection of the leader of a fresh web, and the other photocell of each pair transmits a signal in response to detection of the trailing end of a running web. While a web is fed by the first advancing rolls, the leader of a fresh web is threaded between the second advancing rolls and into the range of the nearest photocell to cause the generation of a visible or audible signal. The signal which is generated in response to detection of the trailing end of the running web is used to start the second advancing rolls. The procedure is analogous in connection with threading of a fresh web between the first advancing rolls and into the range of the nearest photocell, and also in connection with the generation of a signal on detection of the trailing end of the web which is fed by the second advancing rolls.

10 Claims, 1 Drawing Figure

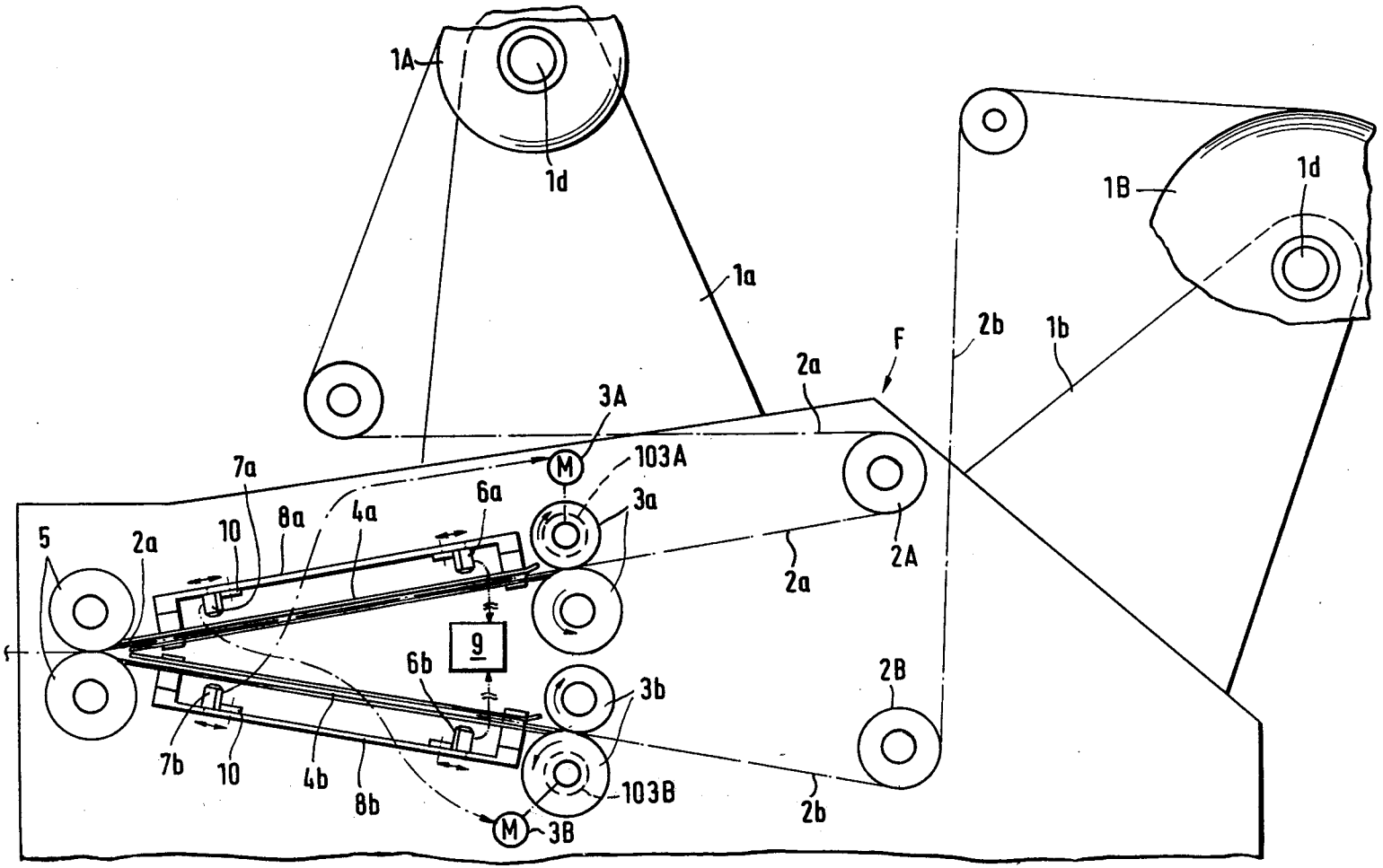
1d
1B
1b
2b
F
2A
2B
2a
2a
2b
1a
103A
3a
3b
103B
3A
M
3B
M
1d
6a
9
6b
1A
4a
8b
4b
8a
7a
10
10
7b
2a
5

APPARATUS FOR FEEDING SERIATIM DISCRETE WEBS OF PAPER OR THE LIKE

BACKGROUND OF THE INVENTION

The present invention relates to improvements in apparatus for manipulating elongated flexible webs or strips which consist of paper, cardboard, metallic foil, foamed synthetic plastic material, synthetic plastic material which confines bubbles or cushions of air or another gas, or the like. More particularly, the invention relates to improvements in apparatus for feeding seriatim discrete webs of flexible material toward and into a predetermined path wherein the webs advance toward and/or past one or more processing stations. Still more particularly, the invention relates to improvements in apparatus wherein successive webs are to be fed to one or more processing stations with a minimum of delay between the completion of feeding of a running web and the start of feeding of a fresh web.

It is already known to provide a web feeding apparatus with automatic means which can place, alternatively, two discrete reels of convoluted web material to a position for withdrawal of the web therefrom. The leader of the fresh web must be threaded into the transporting system by hand. In many instances, the width of gaps between successive webs cannot exceed a certain value so that the threading of the leader of a fresh web must be carried out by a highly skilled person to thereby insure that the leader of the fresh web is located practically immediately behind the trailing end of the preceding web. However, even if the work is performed by a highly skilled attendant, the apparatus must be slowed down or brought to a full stop which affects the output and might interfere with the operation of associated apparatus. If the leader of a fresh web is to be spliced to the trailing end of the preceding web, the attendant must apply one or more adhesive-coated uniting bands which is bound to further prolong the interval of idleness or the interval of operation at a reduced speed. Furthermore, the splicing operation normally involves trimming off the remnant of the preceding web behind the splice. Another serious drawback of the just described conventional apparatus and techniques is that an attendant must observe the operation in order to make sure that a fresh web will be introduced into the apparatus as soon as the supply of preceding web is exhausted or is about to be exhausted. If the webs are to be fed at an elevated speed, and if a reel contains a relatively small quantity of convoluted web material, the supply of expiring web must be monitored practically without any interruptions.

OBJECTS AND SUMMARY OF THE INVENTION

An object of the invention is to provide a novel and improved apparatus which can feed successive discrete webs of paper, cardboard, synthetic plastic material or the like and which is constructed and assembled in such a way that the speed of transport need not be reduced during introduction of fresh supplies of web material.

Another object of the invention is to provide a web feeding apparatus which requires a minimum of attention and is provided with novel and improved means for drawing an attendant's attention to the need for introduction of a fresh web well ahead of actual expiration of the running web.

A further object of the invention is to provide an apparatus which allows for complete consumption of each of a series of webs of finite length and which enables the person in charge to select the spacing between the trailing end of a preceding web and the leader of the next following web.

An additional object of the invention is to provide the apparatus with novel and improved means for monitoring the transport of successive webs and for automatically initiating the feed of a fresh web when the supply of preceding (running) web is exhausted or about to be exhausted.

An ancillary object of the invention is to provide the apparatus with novel and improved carrier means for the devices which monitor the progress of running webs and/or the positions of leaders of fresh webs.

Another object of the invention is to provide an apparatus which can transport successive webs at any desired practical speed and can maintain the selected speed during introduction of the leader of a fresh web as well as during acceleration of the fresh web to full speed.

The invention is embodied in an apparatus for feeding, seriatim, webs of paper or the like. The apparatus comprises first and second support means for discrete sources of finite lengths of webs (e.g., discrete reels of convoluted paper, cardboard or synthetic plastic strip stock), a pair of constantly driven rolls or analogous transporting means for successive webs, first intermittently actuatable web advancing means between a source in or on the first support means and the transporting means, second intermittently actuatable web advancing means between a source in or on the second support means and the transporting means (each advancing means may comprise two rolls which can be set in motion in response to engagement of clutches or in response to starting of suitable prime movers), first guide means defining a first elongated path for movement of a web from the first advancing means into the range of the transporting means (i.e., into the nip of the aforementioned transporting rolls), second guide means defining a second elongated path for movement of a web from the second advancing means into the range of the transporting means, and a pair of photocells or analogous detectors adjacent to each of the two elongated paths. One detector of each pair is nearer to the respective advancing means and includes means (e.g., the receiver of a photocell) for generating a signal in response to detection of the trailing end of a web in the respective path (such signal can be used to actuate a device which furnishes visible and/or audible signals). The other detector of each pair has means for generating a signal in response to detection of the trailing end of a web in the respective path. The signal which is generated by the other detector adjacent to the first path preferably serves to actuate the second advancing means, and the signal which is generated by the other detector adjacent to the second path is preferably used to actuate the first advancing means.

At least one detector of each pair is preferably reciprocable in the longitudinal direction of the respective path.

While the first advancing means draws a web from the source in the first support means and such web moves along the first path into the range of the transporting means, an attendant introduces the leading end of the web which constitutes the source in the second support means into the second path so that the one detector which is adjacent to the second path transmits a signal. This indicates that the web in the second path is ready for movement into the range of the transporting means and this takes place as soon as the trailing end of the web which is drawn from the source in the first support means advances beyond the other detector of that pair of detectors which are adjacent to the first path. The mode of operation is analogous while the second advancing means moves a web toward and into the range of the transporting means.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

BRIEF DESCRIPTION OF THE DRAWING

The single FIGURE of the drawing is a fragmentary partly diagrammatic elevational view of an apparatus which embodies the invention.

DESCRIPTION OF THE PREFERRED EMBODIMENTS

The apparatus which is shown in the drawing comprises two supports 1*a* and 1*b* for sources 1A, 1B of discrete webs 2*a*, 2*b* of finite length and each consisting of paper, cardboard, foamed synthetic plastic material, synthetic plastic material which contains confined cushions of air or the like. Each of the sources 1A, 1B is a reel whose core is detachable from a suitable spindle 1*d* of the respective support. The supports 1*a* and 1*b* are mounted in or on a frame or housing F which carries an idler guide roll 2A for the web 2*a* and an idler guide roll 2B for the web 2*b*. These guide rolls direct the respective webs 2*a*, 2*b* into the nips of two pairs of advancing rolls 3*a*, 3*b* whose shafts are supported by the frame F. At least one of the advancing rolls 3*a* is driven by a prime mover 3A (e.g., a variable speed electric motor), and at least one advancing roll 3*b* is driven by a second prime mover 3B. The other advancing roll is preferably biased against the respective driven advancing roll. The directions in which the advancing rolls 3*a*, 3*b* rotate when the associated motors are on are indicated by arrows.

The advancing rolls 3*a* feed successive increments of the web 2*a* into an elongated channel which is defined by two plate-like guide members 4*a* which preferably consist of a suitable synthetic plastic material and define an elongated path for the web 2*a* wherein the latter advances toward a pair of continuously driven transporting rolls 5.

The advancing rolls 3*b* feed successive increments of the web 2*b* into an elongated channel which is defined by two plate-like guide members 4*b* each of which preferably consists of synthetic plastic material. The outlet of the channel between the guide members 4*b* directs the web 2*b* into the nip of the transporting rolls 5. It will be noted that the outlets of both channels are close to each other so as to insure that the web 2*a* finds its way into the nip of the rolls 5 when the motor 3A is on while the motor 3B is idle, and that the web 2*b* finds its way into the nip of the rolls 5 when the motor 3B is on while the motor 3A is idle.

A carrier 8*a* which is adjacent to the upper guide member 4*a* supports two detectors 6*a* and 7*a* which are shiftable therealong in and counter to the direction of transport of the web 2*a* toward the transporting rolls 5. Each of the illustrated detectors is a photocell whose light source directs a beam of light into a slot (not specifically shown) of the upper guide member 4*a* so that the light beam is reflected into the receiver of the respective cell when it impinges upon a web of paper, cardboard or the like. The output of the receiver of the cell 6*a* is connected to a signal generating device 9 (e.g., a lamp or a horn) which furnishes a preferably short-lasting visible or audible indication when the leader of the web 2*a* is in register with the light source of the cell 6*a*. The receiver of the photocell 7*a* is designed to furnish a signal which starts the motor 3B for one of the advancing rolls 3*b* when the trailing end of the web 2*a* advances beyond the cell 7*a*.

A second carrier 8*b* is adjacent to the lower guide member 4*b* and supports two adjustable (shiftable) detectors (preferably photocells) 6*b*, 7*b* whose functions are respectively analogous to those of the photocells 6*a*, 7*a*. Thus, the signal at the output of the receiver of the cell 6*b* causes the device 9 to furnish a visible or audible signal when the cell 6*b* detects the leader of the web 2*b*, and the signal at the output of the receiver of the cell 7*b* initiates the starting of motor 3A when the trailing end of the web 2*b* advances beyond the cell 7*b*. The operative connections between the cells 7*a*, 7*b* and the respective motors 3B, 3A are indicated by phantom lines, the same as the connections between the cells 6*a*, 6*b* and the device 9. If desired, each of the cells 6*a*, 6*b* can transmit signals to a discrete device which furnishes visible and/or audible signals.

The slides 10 for the photocells 6*a*, 6*b*, 7*a*, 7*b* are preferably shiftable in suitable tracks of the carriers 8*a*, 8*b* and engage such tracks with a minimum of clearance so that each photocell remains in the selected position unless its slide is intentionally shifted toward or away from the transporting rolls 5. Alternatively, the slides 10 can be fixedly held in selected positions by screws or the like. The carriers 8*a* and 8*b* can be provided with suitable indicia (e.g., with graduated scales) to facilitate the shifting of photocells to selected positions. The drawing shows that the photocells 6*a*, 6*b* are located close behind the respective advancing rolls 3*a*, 3*b* and that the photocells 7*a*, 7*b* are located ahead of and close to the transporting rolls 5.

Instead of effecting starting or stoppage of the motors 3A and 3B, the signals which are furnished by the photocells 7*a*, 7*b* can be used to energize or deenergize suitable clutches (e.g., electromagnetic clutches) 103A, 103B which are interposed between the motors 3A, 3B and the respective driven advancing rolls. This renders it possible to maintain the motors 3A and 3B in operation regardless of whether the nip of the transporting rolls 5 receives the web 2*a* or the web 2*b*. Furthermore, this renders it possible to use a single electric motor which drives at least one of the advancing rolls 3*a*, at least one of the advancing rolls 3*b* and one or both transporting rolls 5.

The operation is as follows:

It is assumed that the circuit of the motor 3A is completed so that the rolls 3*a* advance the web 2*a* toward the nip of the transporting rolls 5 which advance the web 2*a* to a processing station, not shown. For example, the processing station may include instrumentalities which subdivide the web 2*a* into sections of desired length. The support 1b is assumed to be empty. This is noted by an attendant because the device 9 fails to furnish a detectable signal. The operator places the reel 1B onto the spindle 1d of the support 1b and threads the leader of the web 2b into the apparatus, i.e., around the guide roll 2B and into and beyond the nip of the advancing rolls 3b (which are not driven) so that the foremost portion of the leader reaches the light beam issuing from the light source of the photocell 6b. The device 9 then furnishes a signal, i.e., the attendant is informed that the fresh web 2b is ready for transport to the processing station immediately upon expiration of the supply of running web 2a. The reel 1B can be mounted on the respective spindle 1d by hand or by an automatic or semiautomatic mechanism, depending on the size of the reels and on the length of intervals which elapse during consumption of a supply of web 2a or 2b.

When the supply of material on the reel 1A is exhausted, the trailing end of the web 2a advances beyond the photocell 7a which transmits a signal resulting in starting of the motor 3B for the advancing rolls 3b. Thus the leader of the web 2b begins to advance toward and into the nip of the continuously driven transporting rolls 5 practically immediately after complete exhaustion of the supply of web 2a. The signal which appears at the output of the receiver of the cell 7a can further serve to effect stoppage of the motor 3A as well as to erase the visible or audible signal which is furnished by the device 9. Circuitry of such character is well known in the art and, therefore, the exact details thereof are not shown in the drawing.

The mode of operation is analogous when the trailing end of the web 2b advances beyond the photocell 7b. In the interim, the attendant has replaced the core of the expired reel 1A with a fresh reel whose leader is threaded into the apparatus so that it interrupts or reflects the light beam issuing from the light source of the photocell 6a. The attendant then knows that the freshly introduced web (replacing the web 2a) is ready for transport into the nip of the rolls 5 as soon as the supply of web 2b is exhausted. When the trailing end of the web 2b moves beyond the cell 7b, the latter starts the motor 3A and the fresh web begins to advance in the channel between the guide members 4a and on toward the transporting rolls 5.

The feature that the cells 6a, 6b are shiftable toward or away from the associated cells 7a, 7b and/or vice versa enables the attendant to select the length of the clearance between the trailing end of the expired web and the leader of the fresh web. For example, if the distance between the cells 6a, 7a is the same as that between the cells 6b, 7b, the length of clearances between successively transported webs will be the same. In fact, the cells 6a, 6b, 7a and 7b can be moved to such positions that the leader of a fresh web overlaps the trailing end of the expired web or that the foremost end of the leader of a fresh web abuts against the rearmost portion of the preceding web.

An important advantage of the improved apparatus is that a fresh reel can be mounted on the respective support, and that the leader of the fresh web can be placed in an optimum position for transport, at any time while a running web is in the process of advancing toward and beyond the rolls 5. The person in charge is then free to devote his or her attention to another apparatus or to perform any other work. When the device 9 again furnishes a signal (such signal may constitute the disappearance of a visible or termination of an audible signal), the person in charge knows that the expired reel must be replaced.

Another advantage of the improved apparatus is that the attendant need not start or stop one of more prime movers because the photocells 7a, 7b automatically start the prime movers or engage the clutches when the supply of a running web is exhausted.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the claims.

What is claimed is:

1. In an apparatus for feeding seriatim webs of paper or the like, the combination of first and second support means for discrete sources of finite lengths of webs; transporting means for successive webs; first intermittently actuatable web advancing means between a source in said first support means and said transporting means; second intermittently actuatable web advancing means between a source in said second support means and said transporting means; first guide means defining a first path for movement of a web from said first advancing means into the range of said transporting means; second guide means defining a second path for movement of a web from said second advancing means into the range of said transporting means; and a pair of detectors adjacent to each of said paths, one detector of each pair being nearer to the respective advancing means and including means for generating a signal in response to detection of the trailing end of a web in the respective path, and the other detector of each pair having means for generating a signal in response to detection of the trailing end of a web in the respective path.

2. The combination of claim 1, further comprising carrier means for said detectors, at least one detector of each of said pairs being movable with respect to said carrier means toward and away from the corresponding advancing means.

3. The combination of claim 1, wherein said detectors are photocells.

4. The combination of claim 1, wherein at least one of said guide means includes a pair of spaced-apart plate-like guide members.

5. The combination of claim 4, wherein said guide members consist of synthetic plastic material.

6. The combination of claim 1, further comprising means for furnishing visible and/or audible indications in response to signals from said one detector of each of said pairs.

7. The combination of claim 1, further comprising means for actuating said second advancing means in response to a signal denoting detection of the trailing end of a web in said first path and means for actuating said first advancing means in response to a signal denoting detection of the trailing end of a web in said second path.

8. The combination of claim 1, wherein said transporting means inclues a pair of continuously driven rolls.

9. The combination of claim 1, wherein each of said sources is a reel of convoluted web material and each of said advancing means comprises a pair of rolls.

10. The combination of claim 9, further comprising elongated carrier means for each pair of detectors and each detector including a portion which is reciprocable lengtwise of the respective carrier means along a substantially straight path extending between said transporting means and the respective advancing means.

* * * * *